US007509965B2

(12) United States Patent
Wu

(10) Patent No.: US 7,509,965 B2
(45) Date of Patent: Mar. 31, 2009

(54) VENTILATED UMBRELLA

(76) Inventor: Tsun-Zong Wu, 8F.No.76, Lane 103, Nei-Hu Road, Sec. 2, Taipei City 114 (TW)

( * ) Notice: Subject to any disclaimer, the term of this patent is extended or adjusted under 35 U.S.C. 154(b) by 332 days.

(21) Appl. No.: 11/385,847

(22) Filed: Mar. 22, 2006

(65) Prior Publication Data

US 2007/0137682 A1 Jun. 21, 2007

(30) Foreign Application Priority Data

Dec. 16, 2005 (CN) ..... 94 2 22046

(51) Int. Cl.
*A45B 25/06* (2006.01)
*A45B 25/22* (2006.01)

(52) U.S. Cl. ..... 135/28; 135/33.7; 135/33.2

(58) Field of Classification Search ..... 135/15.1, 135/28, 33.2, 33.7, 38, 40
See application file for complete search history.

(56) References Cited

U.S. PATENT DOCUMENTS 2,522,645 A * 9/1950 Senna ..... 135/27
6,167,894 B1 * 1/2001 Lin ..... 135/15.1
6,202,662 B1 * 3/2001 Lin ..... 135/33.7
6,276,380 B1 * 8/2001 Okuda ..... 135/33.7
6,397,867 B2 * 6/2002 You ..... 135/33.7
2002/0078986 A1 * 6/2002 Tsun ..... 135/33.7
2003/0041888 A1 * 3/2003 Sung ..... 135/16

* cited by examiner

*Primary Examiner*—David Dunn
*Assistant Examiner*—Noah Chandler Hawk
(74) *Attorney, Agent, or Firm*—Muncy, Geissler, Olds & Lowe, PLLC

(57) ABSTRACT

A ventilated umbrella includes a foldable frame, upper canopy and lower canopy. An upper and lower stopping rings with certain interval there between are disposed under the upper notched ring of the main shaft while a notched ring for string is slidable between the two stopping rings and a compression spring is between the notched ring for string and the lower stopping ring. A plurality of radial vertical slots with larger inner slots and smaller outer slots are disposed evenly on the notched ring for string so that one end of a plurality of strings is set into the vertical slot and restrained by a ring while the other end is connected to upper circumference of the lower canopy. And the connection point is located under a horizontal line formed by joints between the main ribs and the stretchers. Thereby a plurality of strings is easy to attach on the notched ring for string. When the umbrella is folded, the notched ring for string returns back by elasticity of the compression spring and simultaneously the upper and the lower canopies are pulled smoothly so that the upper and the lower canopies are rolled up conveniently.

3 Claims, 11 Drawing Sheets

VENTILATED UMBRELLA

BACKGROUND OF THE INVENTION

The present invention relates to a ventilated umbrella, especially to an umbrella that when the umbrella is stretched, the upper circumference of the lower canopy is stretched by a plurality of strings so that the lower canopy and the upper canopy are separated for ventilation. When being folded, the lower canopy is smoothed by the strings so that the upper and the lower canopies are convenient to roll up.

There are various designs of foldable umbrellas with functions of windproofing/ventilation, as disclosed by U.S. Pat. No. 2,522,645, U.S. Pat. No. 3,032,047, U.S. Pat. No. 4,979,534, U.S. Pat. No. 5,368,055, U.S. Pat. No. 5,487,401, U.S. Pat. No. 5,890,506, U.S. Pat. No. 6,006,769, U.S. Pat. No. 6,039,063, U.S. Pat. No. 6,155,278, U.S. Pat. No. 6,167,894, U.S. Pat. No. 6,170,499, U.S. Pat. No. 6,250,319, U.S. Pat. No. 6,202,662, U.S. Pat. No. 6,397,867 and so on. Refer to U.S. Pat. No. 6,167,894, U.S. Pat. No. 6,170,499, U.S. Pat. No. 6,250,319, U.S. Pat. No. 6,202,662, U.S. Pat. No. 6,397,867, a foldable umbrella frame composed by a plurality of ribs, stretchers and a surface. The surface having a plurality of sectors separated by a plurality of stretchers. An upper canopy is disposed on upper surface of the umbrella while a lower canopy is arranged on lower surface of the circumference of the upper canopy. The lower circumference of the upper canopy is overlapped with the upper circumference of the lower canopy. By a plurality of strings with or without elasticity that one end is connected with the upper circumference of the lower canopy and the other end is connected with a fixed/sliding notch/ring on a shaft, the lower canopy is pulled down or the rear end of the shaft is pulled so as to achieve purposes of ventilation/windproofing. However, most of umbrellas only has function of ventilation/windproofing after being pulled out fully, the convenience of usage after being folded is neglected.

Refer to U.S. Pat. No. 6,397,867, from FIG. 1 to FIG. 6, the disadvantages of conventional umbrellas are as followings:

(1) After being folded, due to the change of relative position (angle) between the string P1 and the stretcher P2, the connecting point P5 for string on upper circumference P4 of the lower canopy P3 is loose and saggy, as shown in FIG. 4. Thus there is ridge and knot between the upper canopy P6 and the lower canopy P3. Once the lower canopy P3 is curled into the upper canopy P6, it's inconvenient for users to roll up the canopy as well as unfold the umbrella.

(2) In order to avoid the drooping of the upper circumference P4 of the lower canopy P3, the overlapping area P7 between the upper and the lower canopies P6, P3 need to broaden. And the string P1 connects to the connecting point P5 that is above a horizontal line formed by joints P9 (the position of the stretcher P2 for supporting the main rib P8), as shown in FIG. 1, 2, & 3. This needs more umbrella clothes and the cost is increased. Moreover, the increase of overlapping area makes the ventilated resistance also raise so that the ventilation effect is poor.

(3) As shown in FIG. 4, conventional notched ring P10, rear end P11 of the string is mounted inside the notched ring P10, refer to FIG. 5, this is difficult to assemble and the rear end of the string can't be fixed and easy to move or fall off while being stretched or folded. Another notched ring P12, as shown in FIG. 6, the rear end P11 of the string is inserted into the notched ring P12 through an opening P13 and then a cap P14 is covered on the opening P13 of the notched ring P12 so as to prevent the string from falling off. This makes the structure of the umbrella more complicated and the cost is increased so that it is difficult to be mass-produced.

SUMMARY OF THE INVENTION

Therefore it is a primary object of the present invention to provide a ventilated umbrella having an upper and a lower stopping rings with certain interval therebetween disposed under an upper notched ring of a main shaft. A slidable notched ring for string is disposed between the two stopping rings and a compression spring is arranged on lower part of the notched ring for string. The compression spring presses against the lower stopping ring for elastically supporting the notched ring for string. One end of a plurality of strings is fixed on the notched ring for string while the other end is connected to the upper circumference of the lower canopy. And the connection point is located under a horizontal line formed by joints between the main ribs and the stretchers. Thus the area of umbrella clothes is saved and the cost is reduced with better ventilation effect, convenient folding and unfolding of upper and lower canopies.

It is another object of the present invention to provide a ventilated umbrella having a plurality of radial vertical slots with larger inner slots and smaller outer slots disposed evenly on the notched ring for string so that one end of a plurality of strings is set into the vertical slot and restrained by a ring for preventing the strings falling out of the notched ring for string. Thus the strings are easy to assemble with and fix on the notched ring for string. Therefore, the umbrella is convenient for assembling with stable locating effect.

DETAILED DESCRIPTION OF THE PREFFERED EMBODIMENT

Figure 1:
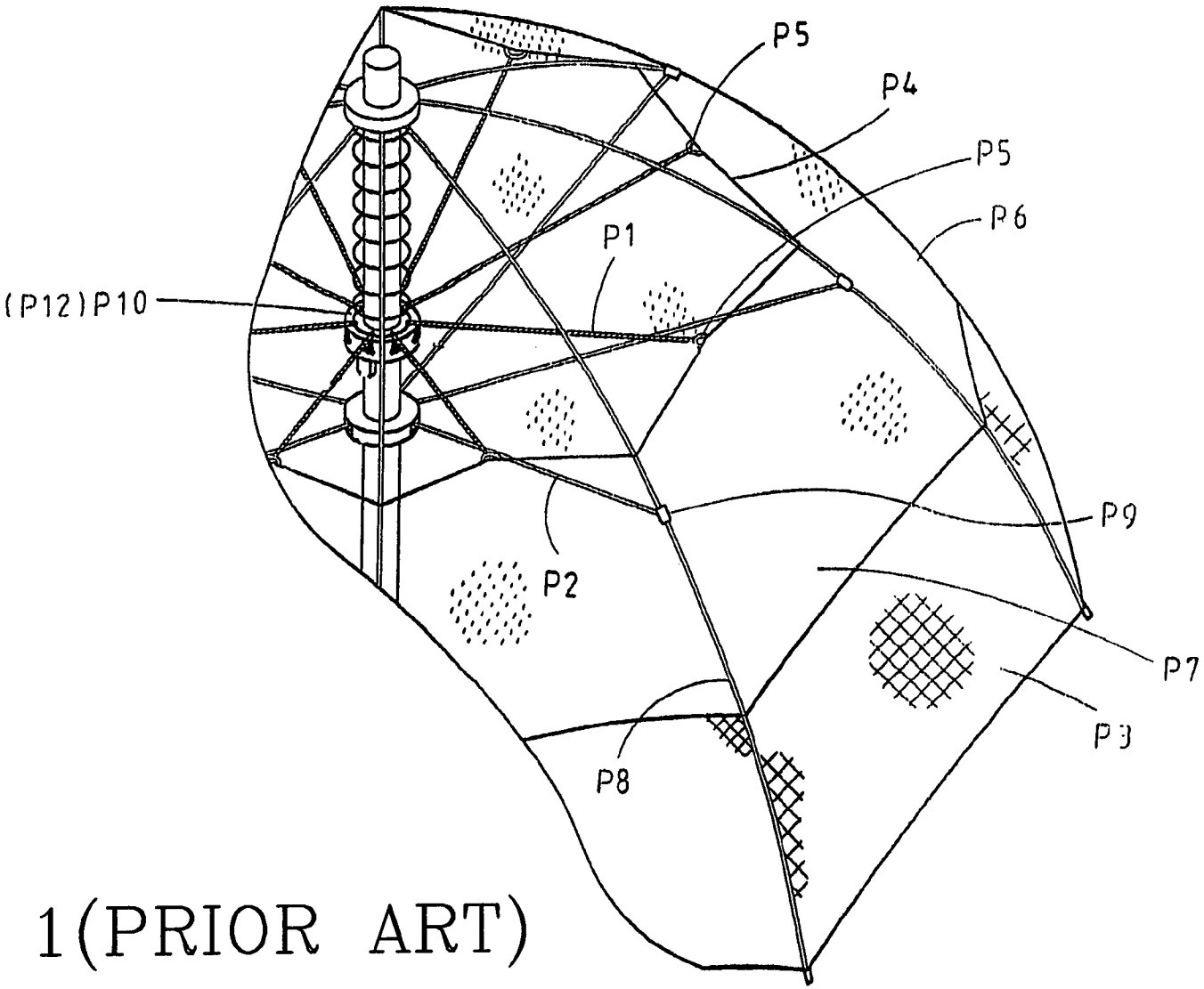
FIG. 1(PRIOR ART)
FIG. 1 is a perspective view of a conventional ventilated umbrella.
Figure 2:
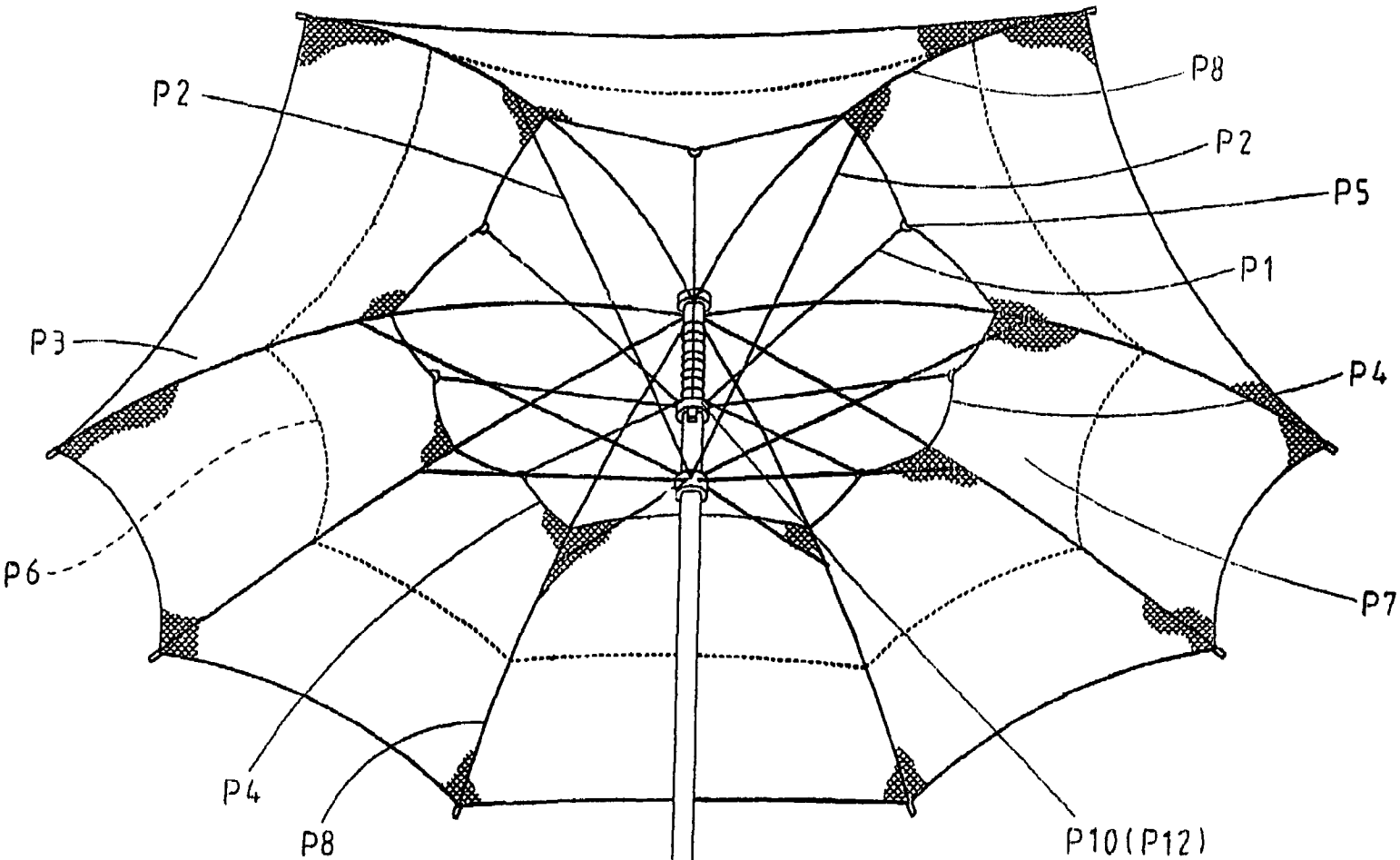
FIG. 2(PRIOR ART)
FIG. 2 is a bottom view of a conventional ventilated umbrella.
Figure 3:
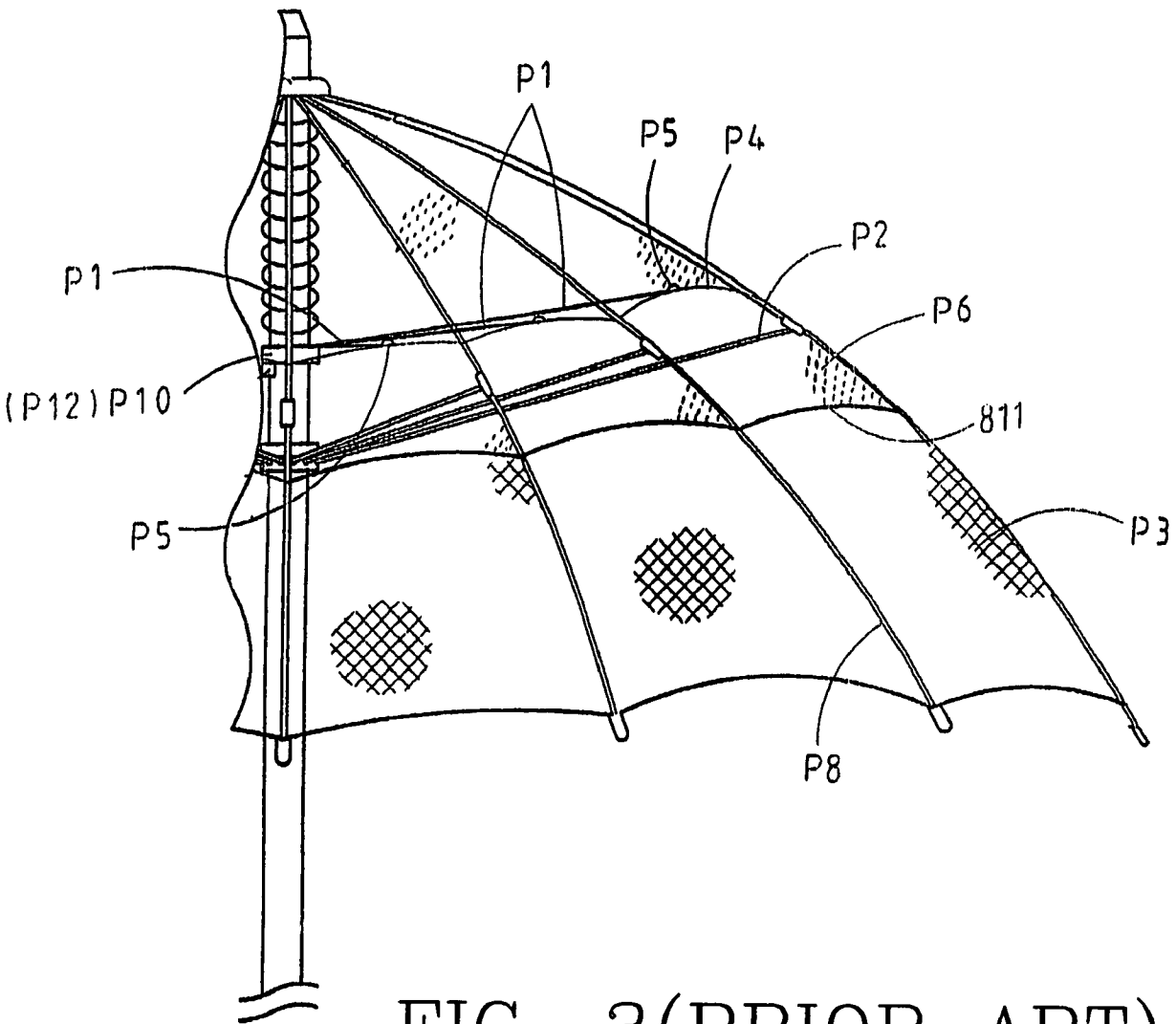
FIG. 3(PRIOR ART)
FIG. 3 is a schematic drawing of a conventional ventilated umbrella.
Figure 4:
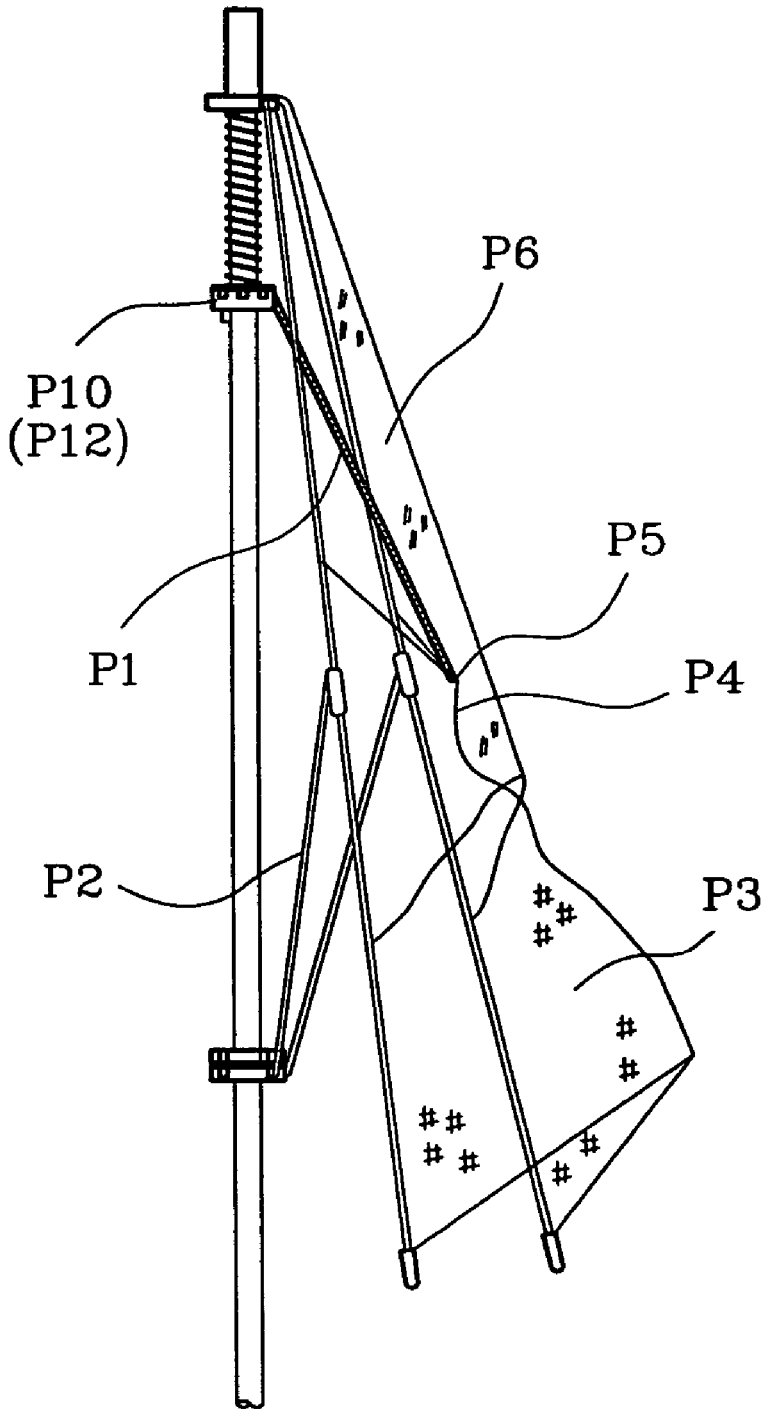
FIG. 4(PRIOR ART)
FIG. 4 is a schematic drawing showing folded status of a conventional ventilated umbrella.
Figure 6:
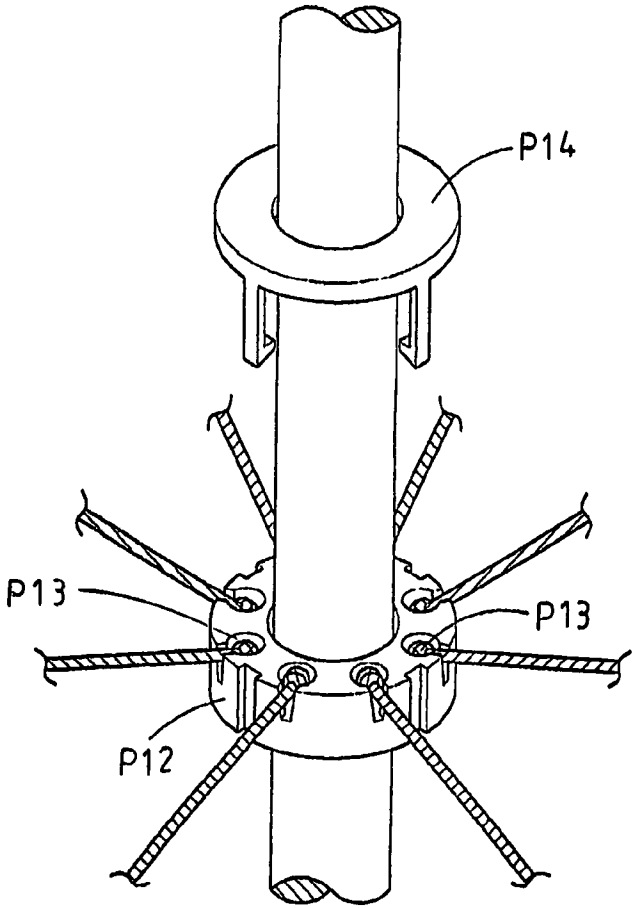
FIG. 6(PRIOR ART)
FIG. 6 is a perspective view of another a notched ring for string of a conventional ventilated umbrella.
Figure 5:
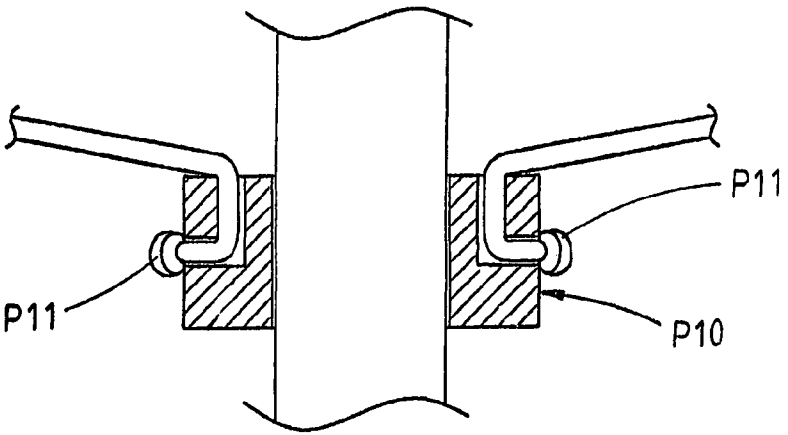
FIG. 5(PRIOR ART)
FIG. 5 is a cross-sectional view of a notched ring for string of a conventional ventilated umbrella.
Figure 7:
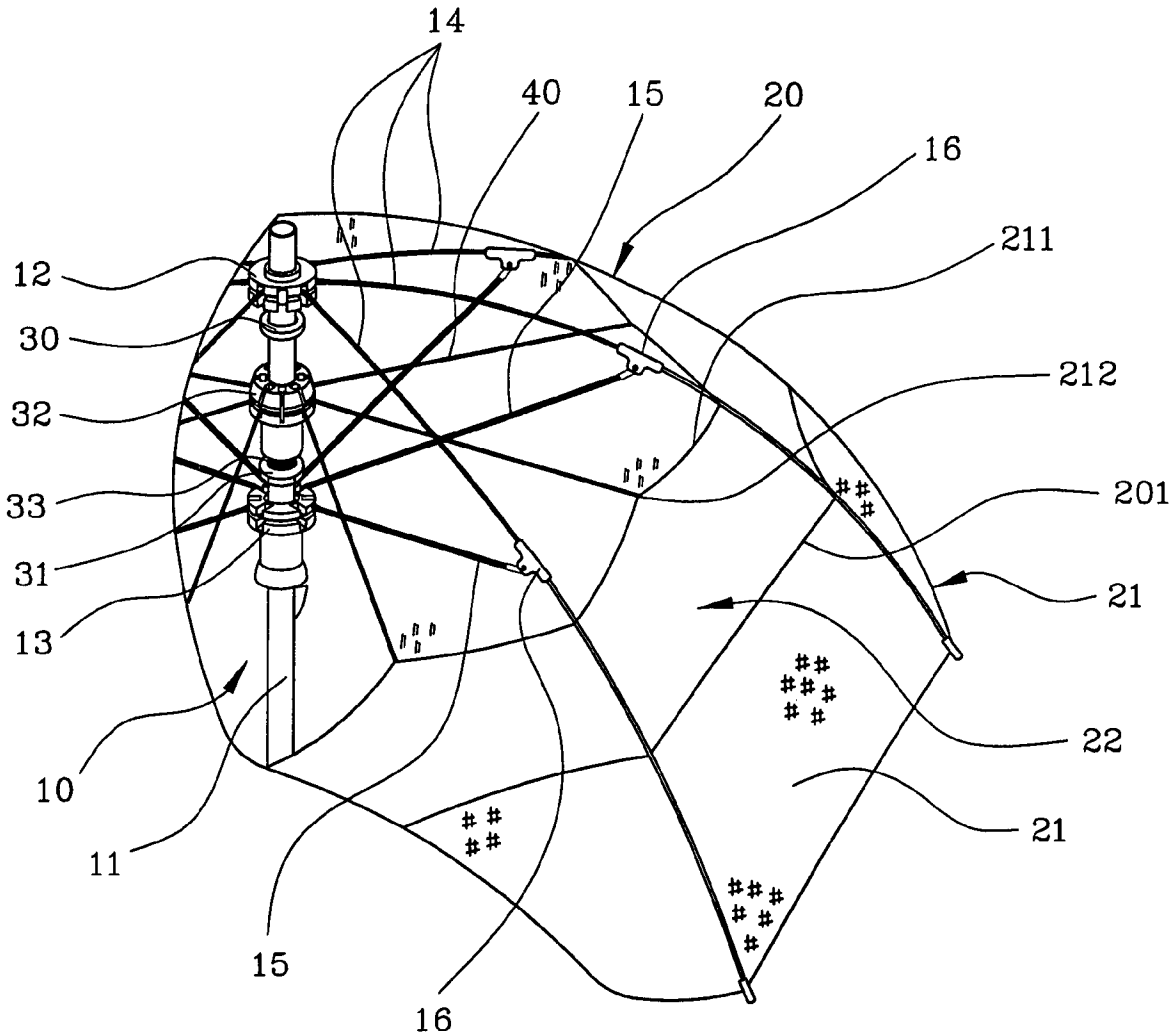
FIG. 7 is a perspective view of an embodiment in accordance with the present invention.
Figure 8:
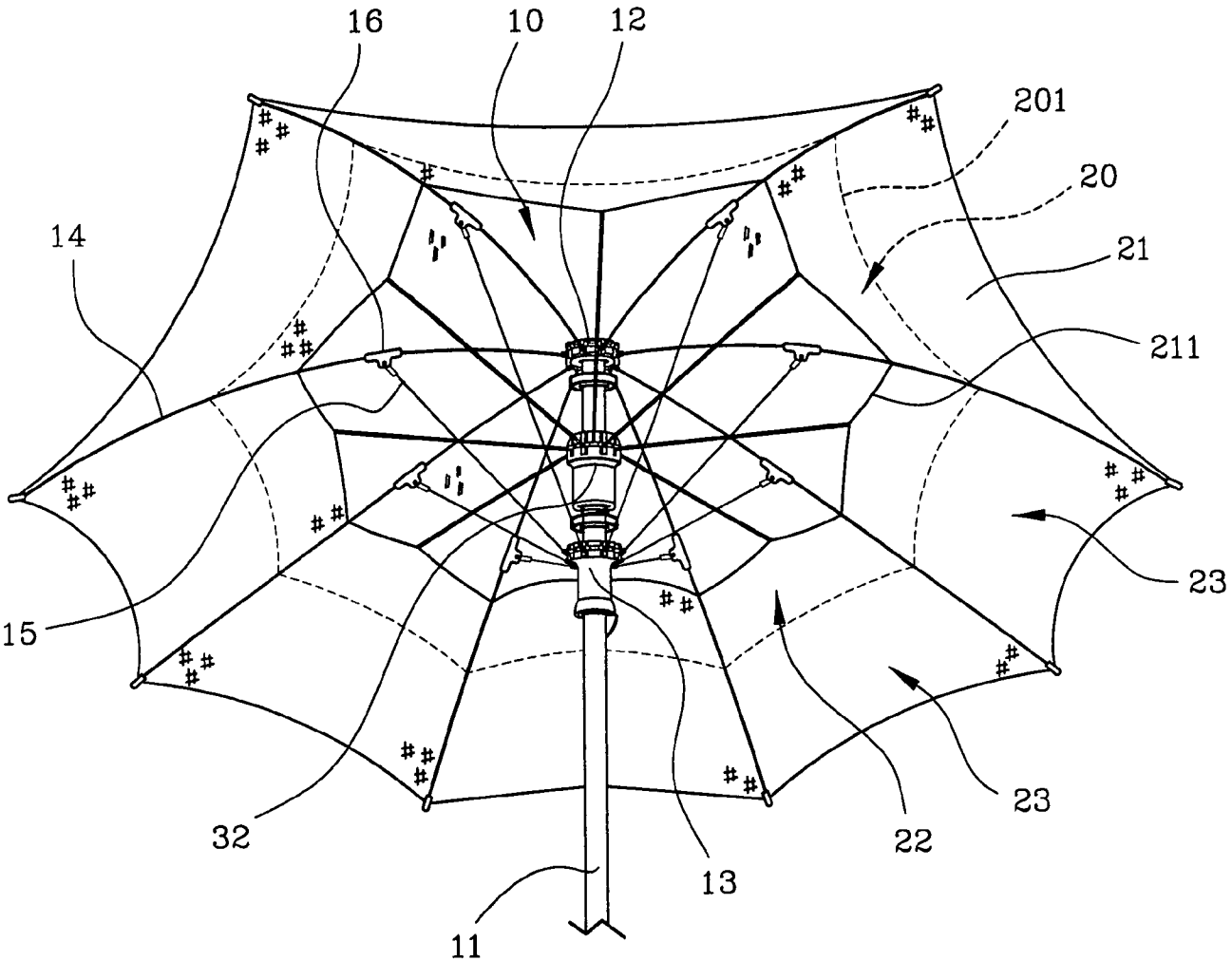
FIG. 8 is a bottom view of an embodiment in accordance with the present invention.

Refer from FIG. 7 to FIG. 10, a ventilated umbrella in accordance with the present invention includes a foldable frame 10, an upper canopy 20 and a lower canopy 21. The foldable frame 10 consists of a main shaft 11, an upper notched ring 12 fixed on top of the main shaft 11, a lower notched ring 13 sliding along the main shaft 11 for folding or unfolding the canopy, a plurality of main ribs 14 with one end thereof pivoted on the upper notched ring 12 and a plurality of stretchers 15 corresponding to the main ribs 14 supported between the main ribs 14 and the lower notched ring 13. The upper canopy 20 is disposed on top of the umbrella surface formed by the main ribs 14 while the lower canopy 21 is arranged on lower part of outer circumference of the upper canopy 20. The lower circumference 201 of the upper canopy 20 is covered on the upper circumference 211 of the lower canopy 21 so as to form canopy overlapping area 22. By a plurality of main ribs 14, the umbrella surface is divided into a plurality of sections 23.

Figure 9:
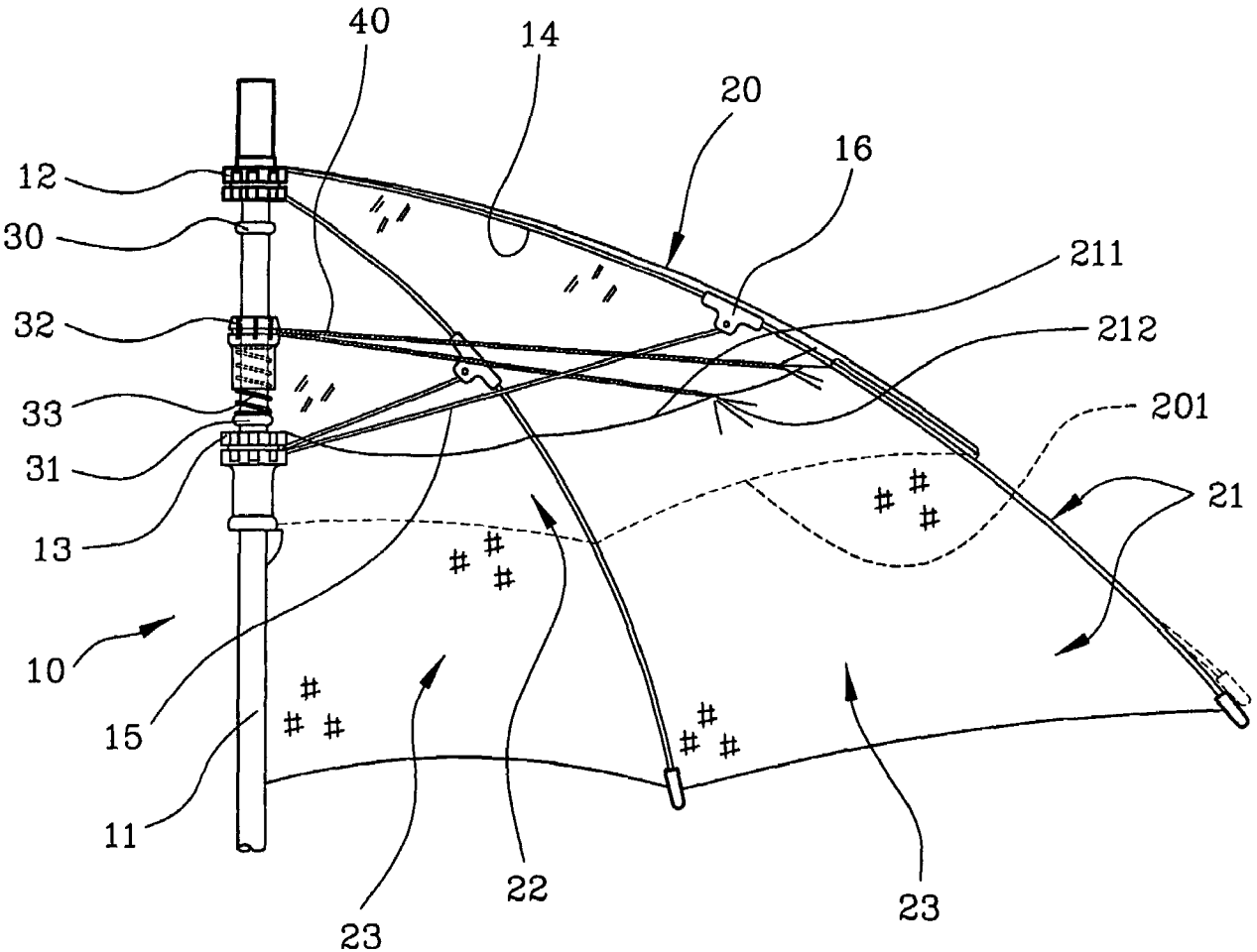
FIG. 9 is a schematic drawing of an embodiment in accordance with the present invention.
Figure 10:
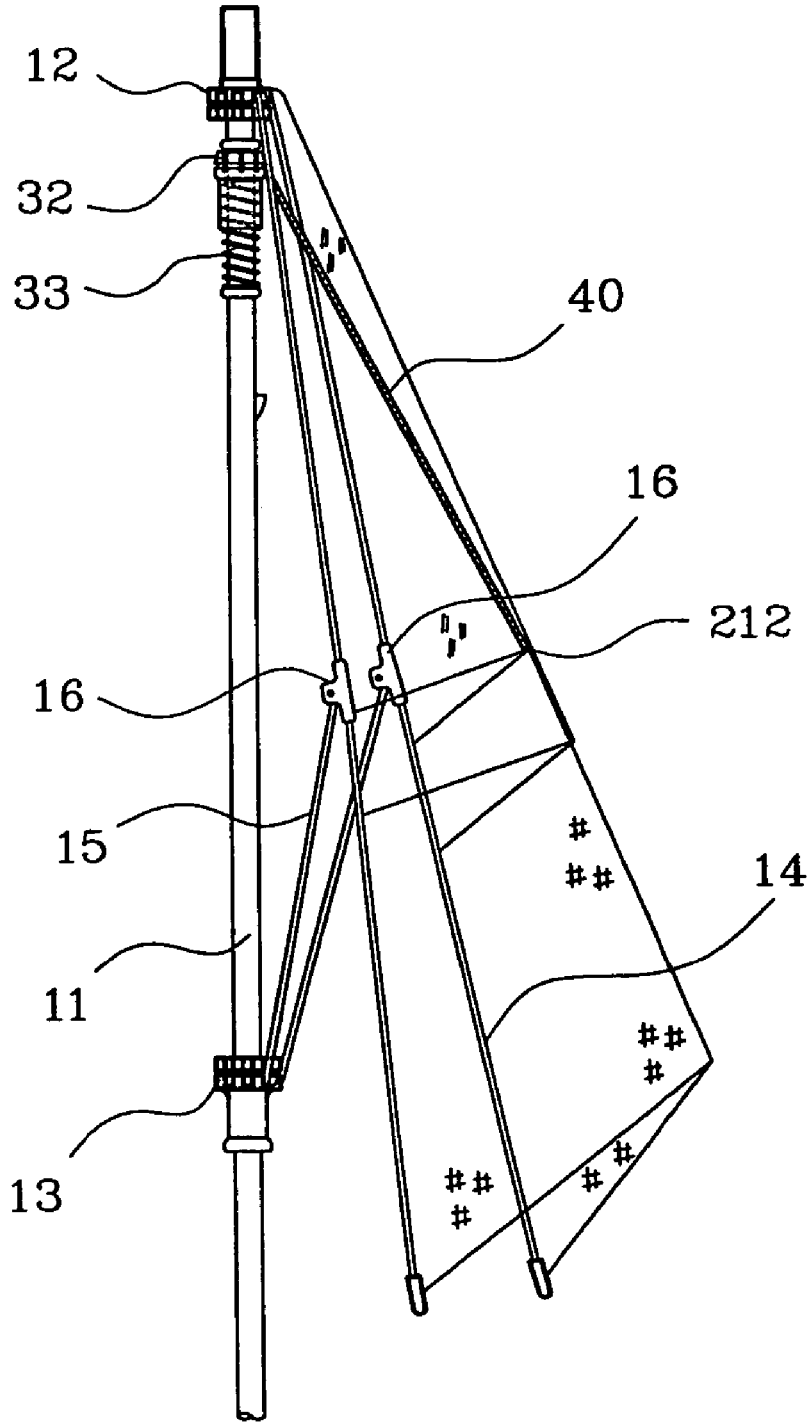
FIG. 10 is a schematic drawing of an embodiment before being folded in accordance with the present invention.
Figure 11:
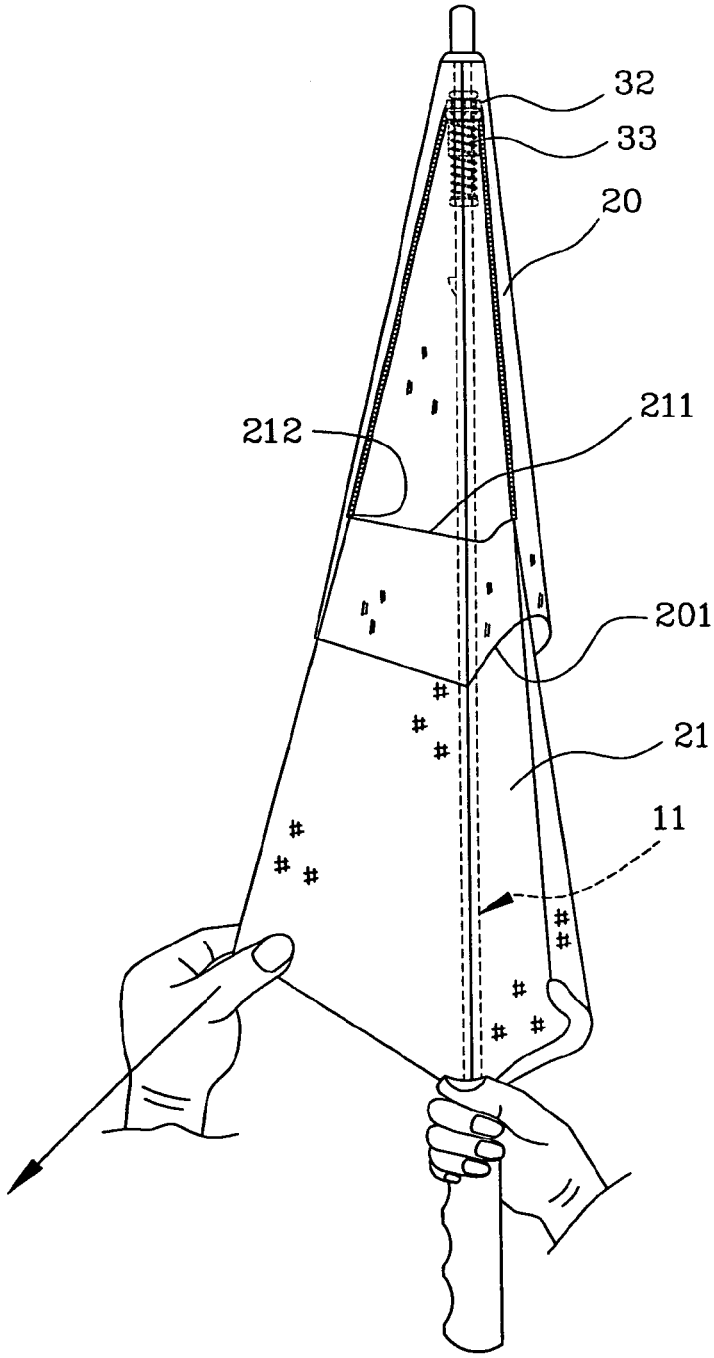
FIG. 11 is a schematic drawing showing how the embodiment is folded.
Figure 12:
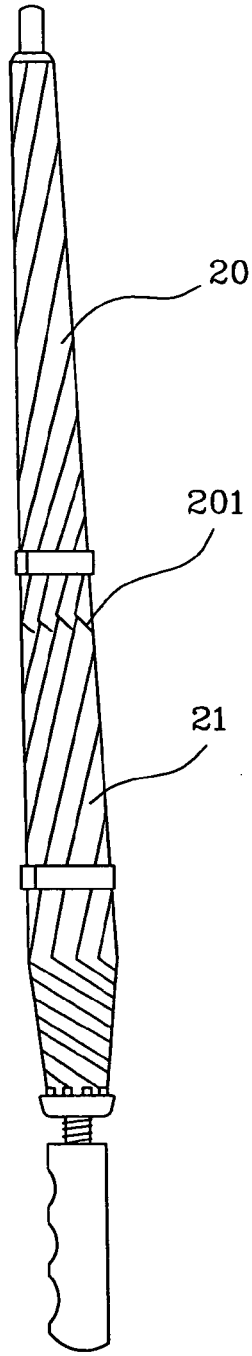
FIG. 12 is a schematic drawing of an embodiment after being folded in accordance with the present invention.
Figures 13, 14:
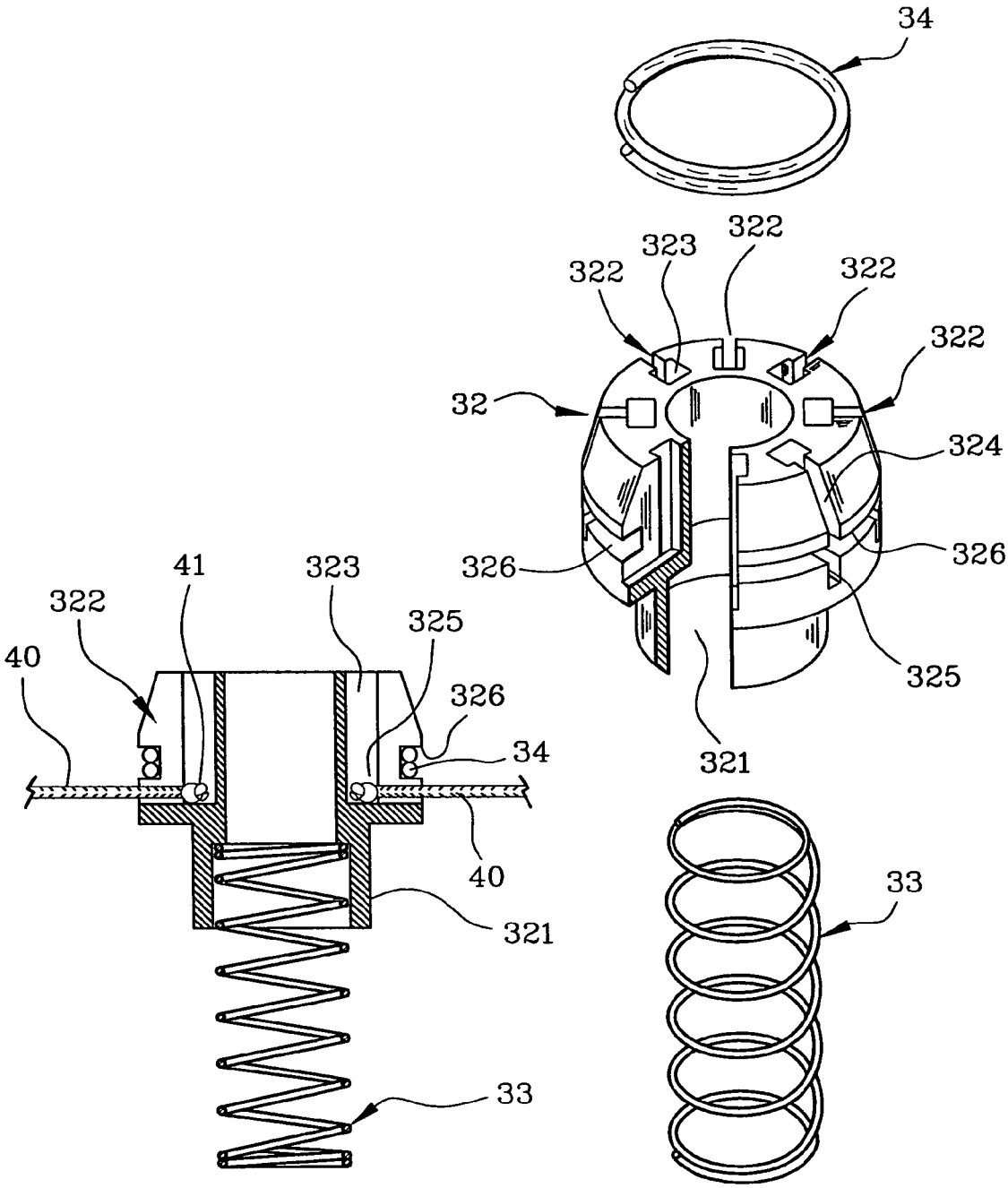
FIG. 13 is an explosive view of a notched ring for string in accordance with the present invention.
FIG. 14 is a cross-sectional view of a notched ring for string in accordance with the present invention.

An upper and a lower stopping rings 30, 31 with certain interval therebetween and a notched ring for string 32 slidable between the two stopping rings 30, 31 are disposed on under the upper notched ring 12 of the main shaft 11. And a slot with an opening 321 for accommodation of a compression spring 33 is arranged on lower part of the notched ring for string 32, as shown in FIG. 13, 14. The lower end of the compression spring 33 presses against the lower stopping ring 31 for elastically supporting the notched ring for string 32. A plurality of strings 40 with one end fixed on the notched ring for string 32 while the other end is connected with central point of upper circumference 211 of each section 23 of the lower canopy21. And the connection point 212 is located under a horizontal line formed by joints 16 between the main ribs14 and the stretchers 15. In other words, the upper circumference 211 of the lower canopy 21 is under the horizontal line formed by the joints 16. Thus when the frame 10 is fully extended, as shown in FIG. 9, the notched ring for string 32 moves downwards by tension of the strings 40 so as to make the compression spring 33 compress downwards while the upper circumference 211 of the lower canopy 21 is pulled by the strings 40 to move toward the main shaft 11 so that the canopy overlapping area 22 between the upper and the lower canopy 20, 21 separated from each other to form a plurality of openings for ventilation. When the frame 10 is folded, as shown in FIG. 10, the notched ring for string 32 returns back by elasticity of the compression spring 33 and simultaneously the upper circumference 211 of the lower canopy 21 is pulled upwards. When users want to fold the canopy, refer to FIG. 11, use the upwards notched ring for string 32 as a fixed point, the upper and the lower canopies 20, 21 are pulled properly and are easy to be rolled up, as shown in FIG. 12.

Refer to FIG. 13, 14, a slot with an opening 321 for accommodation of a compression spring 33 is arranged on lower part of the notched ring for string 32. A plurality of strings 40 with one end fixed on the notched ring for string 32. A plurality of radial vertical holes 322 is evenly disposed on upper part of the notched ring for string 32. The width of an inner slot 232 of the radial vertical hole 322 is larger so that a rear end 41 of the string 40 can be inserted into a bottom end 325 of the radial vertical hole 322 while the width of an outer slot324 is smaller so that the rear end 41 of the string 40 is locked and unable to penetrate. A circular slot 326 is set on middle part of the notched ring for string 32 and over the bottom end 325 of the radial vertical hole 322, connecting with the radial vertical hole 322. A ring 34 is restrained inside the circular slot 326, pressing on the strings 40 so as to prevent the strings 40 out of the radial vertical hole 322. The ring 34 can be made from metal, as shown in FIG. 13, or an elastic plastic ring (not shown in figure). Thereby, the plurality of strings 40 are easy to be assembled and fixed on the notched ring for string 32.

In summary, the present invention has following advantages compared with traditional ventilated umbrella:

(1) After the frame being folded, the notched ring for string 32 returns back by elasticity of the compression spring 33 and simultaneously the upper circumference 211 of the lower canopy 21 is pulled upwards so that the connection point on the upper circumference 211 of the lower canopy 21 won't droop. Thus the upper and the lower canopies 20, 21 are smoothed in the meantime and are easy to be rolled up conveniently. The umbrella can be used more efficiently.

(2) One end of the strings 40 is fixed on the connection point 212 that is located under a horizontal line formed by joints 16. That means the upper circumference 211 of the lower canopy 21 is under the horizontal line formed by the joints 16. Thus the canopy overlapping area 22 between the upper and the lower canopy 20, 21 is reduced so as to save umbrella clothes and reduce cost. Moreover, the ventilated resistance is also reduced due to less overlapping area and thus better ventilation effect is achieved.

(3) The ring 34 restrained inside the circular slot 326 also restrains the strings 40. Thus the structure of the notched ring for string 32 is simplified and easy to assemble. The strings 40 are conveniently to be assembled and fixed on the notched ring for string 32 so that the umbrella is easy to be mass-produced.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A ventilated umbrella comprising:

a foldable frame, an upper canopy and a lower canopy;

the foldable frame having a main shaft, an upper notched ring fixed on top of the main shaft, a lower notched ring sliding along the main shaft for folding or unfolding the canopy, a plurality of main ribs, and a plurality of stretchers, each main rib of the plurality of main ribs has a first end thereof pivotally connected to the upper notched ring, each stretcher of the plurality of stretchers has a first end connected to the lower notched ring and a second end pivotally connected to a corresponding main rib of the plurality of main ribs to form a joint;

the upper canopy is disposed on a top of an umbrella surface formed by the main ribs and the lower canopy is arranged on a lower part of an outer circumference of the upper canopy, and the lower circumference of the upper canopy covers an upper circumference of the lower canopy forming a canopy overlapping area; the umbrella surface is divided into a plurality of sections by the plurality of main ribs;

the upper circumference of the lower canopy is under the horizontal line formed by a plurality of joints; an upper stopping ring and a lower stopping ring with certain interval there between are disposed under the upper notched ring of the main shaft; a notched ring for string is slidable between the upper and lower stopping rings; a plurality of strings; and a compression spring;

a slot with an opening for accommodation of the compression spring is arranged on lower part of the notched ring for string and a plurality of radial vertical holes are disposed on upper part of the notched ring for string; a width of an inner slot of the radial vertical hole is larger than a width of an outer slot so that a rear end of the string is inserted into a bottom end of the radial vertical hole and is locked and unable to penetrate the width of the outer slot; a circular slot is set on middle part of the notched ring for string with a ring restrained therein; a first end of the strings is set into the vertical slot of the notched ring for string and a second end is connected to a center of the upper circumference of each sector of the lower canopy, and the connection point is located under a horizontal line formed by joints;

the compression spring is disposed on the main shaft and the upper end thereof inserts into the slot with an opening and the lower end thereof presses against the lower stopping ring for elastically supporting the notched ring for string;

wherein when the frame is fully stretched, the notched ring for string moves downwards and presses the compression spring by pulling of the string and the upper circumference of the lower canopy extends toward the main shaft so that the upper and lower canopies on overlapping area there between are separated from each other to form a plurality of openings for ventilation; when the frame is folded, the notched ring for string returns back by elasticity of the compression spring and simultaneously the upper circumference of lower canopy is pulled upwards so that the upper and the lower canopies are capable of being smoothed and rolled.

2. The device as claimed in claim 1, wherein the ring is made from a material selected from a group consisting of metal and elastic plastic.

3. The device as claimed in claim 1, wherein the strings are selected from a group consisting of elastic strings and non-elastic strings.

* * * * *